US007243961B2

(12) United States Patent
Fukunaga et al.

(10) Patent No.: US 7,243,961 B2
(45) Date of Patent: Jul. 17, 2007

(54) DOOR LOCK DEVICE AND DOOR LOCK MODULE

(75) Inventors: Katsutoshi Fukunaga, Chiryu (JP); Makoto Suzumura, Chita (JP); Shigehiro Oya, Toyoake (JP); Akira Muramatsu, Chiryu (JP); Yukinobu Kunimatsu, Toyoake (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 186 days.

(21) Appl. No.: 10/853,671

(22) Filed: May 26, 2004

(65) Prior Publication Data

US 2004/0262928 A1 Dec. 30, 2004

(30) Foreign Application Priority Data

May 29, 2003 (JP) ..... 2003-153031

(51) Int. Cl.
*E05C 3/06* (2006.01)

(52) U.S. Cl. ..... 292/216; 292/DIG. 53

(58) Field of Classification Search ..... 292/216, 292/201, DIG. 53, DIG. 64
See application file for complete search history.

(56) References Cited

U.S. PATENT DOCUMENTS 3,400,962 A * 9/1968 Martens ..... 292/216
4,647,092 A * 3/1987 Nakamura ..... 292/216
5,007,668 A * 4/1991 Di Giusto ..... 292/216
5,308,129 A * 5/1994 Hlavaty ..... 292/216
6,010,165 A * 1/2000 Santarelli et al. ..... 292/216
6,189,267 B1 2/2001 Staser
2002/0056996 A1 5/2002 Fukunaga et al.

FOREIGN PATENT DOCUMENTS

DE 197 38 796 A1 3/1999
DE 100 48 706 A1 4/2002
EP 0 508 580 A1 10/1992
EP 1 002 913 A2 5/2000
EP 1 060 918 A1 12/2000
JP 2001-336330 12/2001

OTHER PUBLICATIONS

European Search Report dated Oct. 14, 2005.

* cited by examiner

*Primary Examiner*—Gary Estremsky
(74) *Attorney, Agent, or Firm*—Buchanan Ingersoll & Rooney PC

(57) ABSTRACT

A door lock device for vehicle includes a latch mechanism adapted to be a vehicle door at an inner space of the vehicle door for holding the vehicle door in closing condition against a vehicle body and sifted between an engaging condition and a disengaging condition, a link mechanism for shifts the latch mechanism from the engaging condition to the disengaging condition by an operation of a door handle mechanism which includes a handle member and a frame member arranged in the inner space of the vehicle door for supports the handle member to the vehicle door and connection means for detachably connected with the frame member of the door handle mechanism.

11 Claims, 15 Drawing Sheets

DOOR LOCK DEVICE AND DOOR LOCK MODULE

CROSS REFERENCE TO RELATED APPLICATIONS

This application is based on and claims priority under 35 U.S.C. § 119 to Japanese Patent Application 2003-153031, filed on May 29, 2003, the entire content of which is incorporated herein by reference.

FIELD OF THE INVENTION

This invention generally relates to a door lock device. More particularly, this invention pertains to a door lock device which includes a latch mechanism keeping a vehicle door closed condition and a link mechanism operating the latch mechanism.

BACKGROUND OF THE INVENTION

An example of door lock device and opening operation member is disclosed in Japanese Patent Laid-Open Publication No. 2001-336330. The disclosed document has disclosed about a door lock device, which has been attached at inside of a door. Further, a frame member installing an operation member such as an outside handle has been provided at the door. The outside handle et al. also attached at the interior of the door with the frame member.

Therefore, the door lock device and operation member such as outside handle have to individually attach to the interior of the door in assembling process of the door.

SUMMARY OF THE INVENTION

In light of foregoing, according to an aspect of the present invention, a door lock device includes a latch mechanism adapted to be a vehicle door at an inner space of the vehicle door for holding the vehicle door in closing condition against a vehicle body and sifted between an engaging condition and a disengaging condition, a link mechanism for shifts the latch mechanism from the engaging condition to the disengaging condition by an operation of a door handle mechanism which includes a handle member and a frame member arranged in the inner space of the vehicle door for supports the handle member to the vehicle door and connection means for detachably connected with the frame member of the door handle mechanism.

BRIEF DESCRIPTION OF THE DRAWINGS

The foregoing and additional features and characteristics of the present invention will become more apparent from the following detailed description considered with reference to the accompanying drawing figures wherein.

DETAILED DESCRIPTION

A preferred embodiment of the present invention will be described hereinbelow in detail with reference to the accompanying drawings.

FIRST EMBODIMENT

Figure 1:
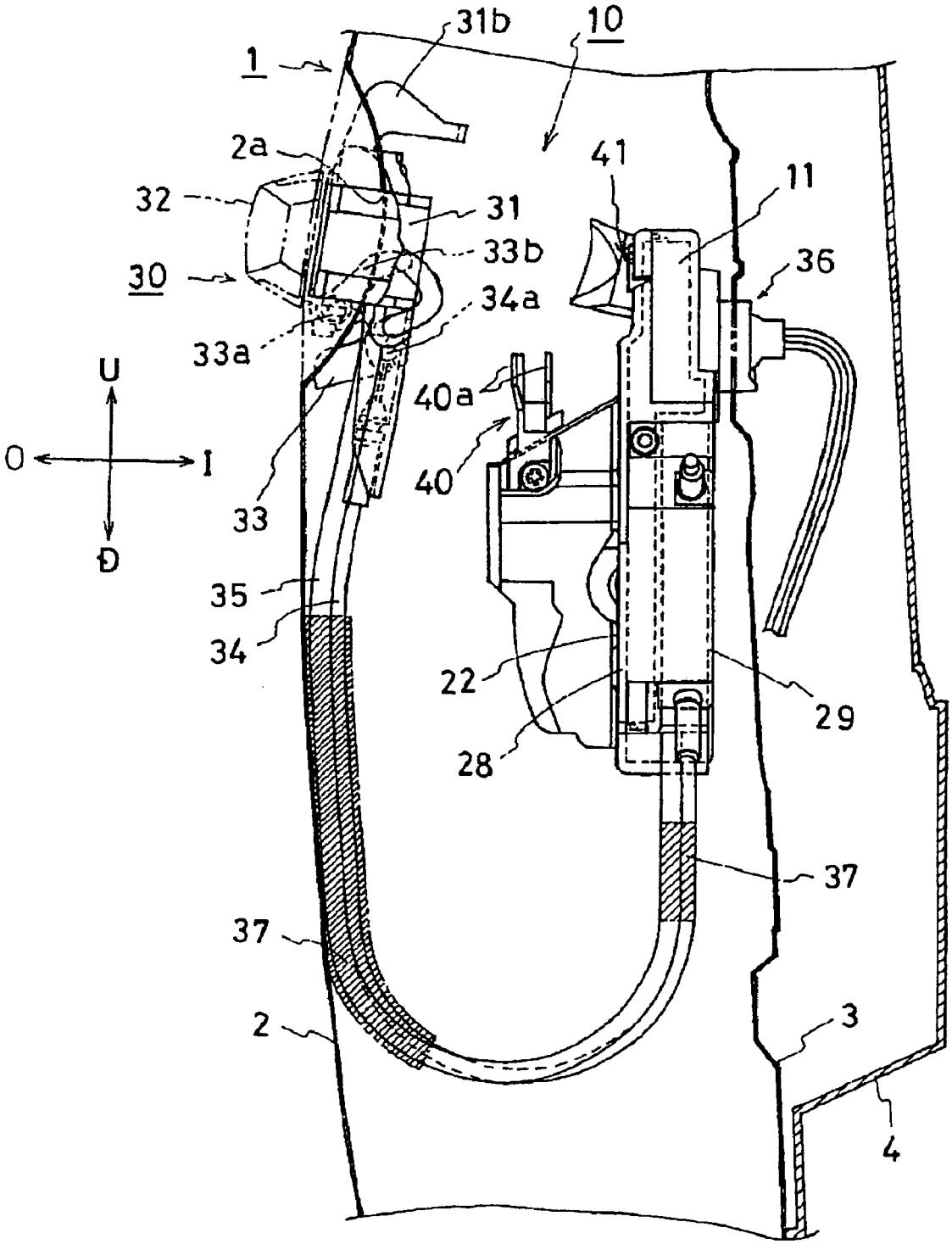
FIG. 1 is a front view schematically illustrating a door lock module provided at a vehicle door according to the first embodiment of the present invention.
Figure 2:
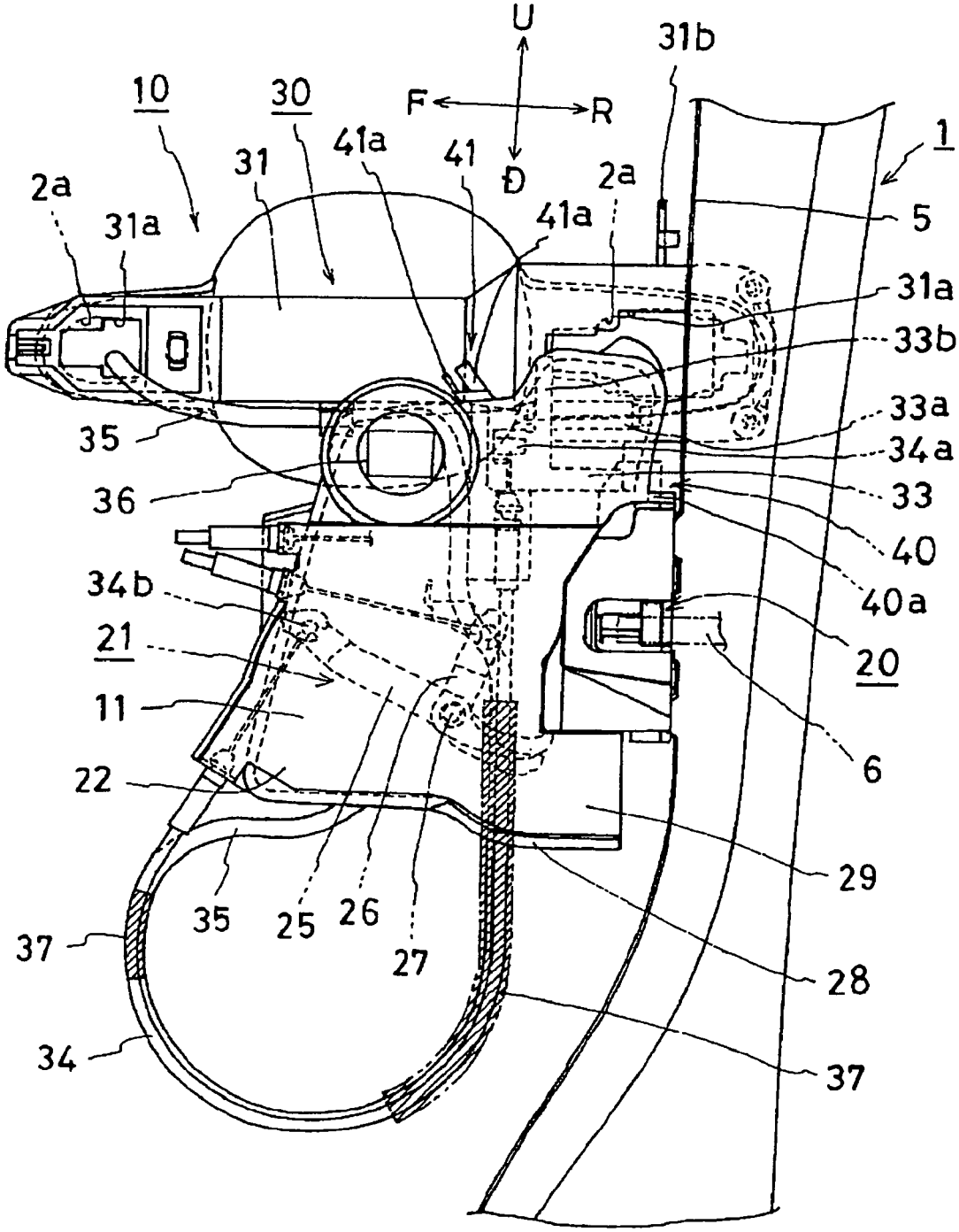
FIG. 2 is a side view schematically illustrating a door lock module provided at a vehicle door according to the first embodiment of the present invention.
Figure 3:
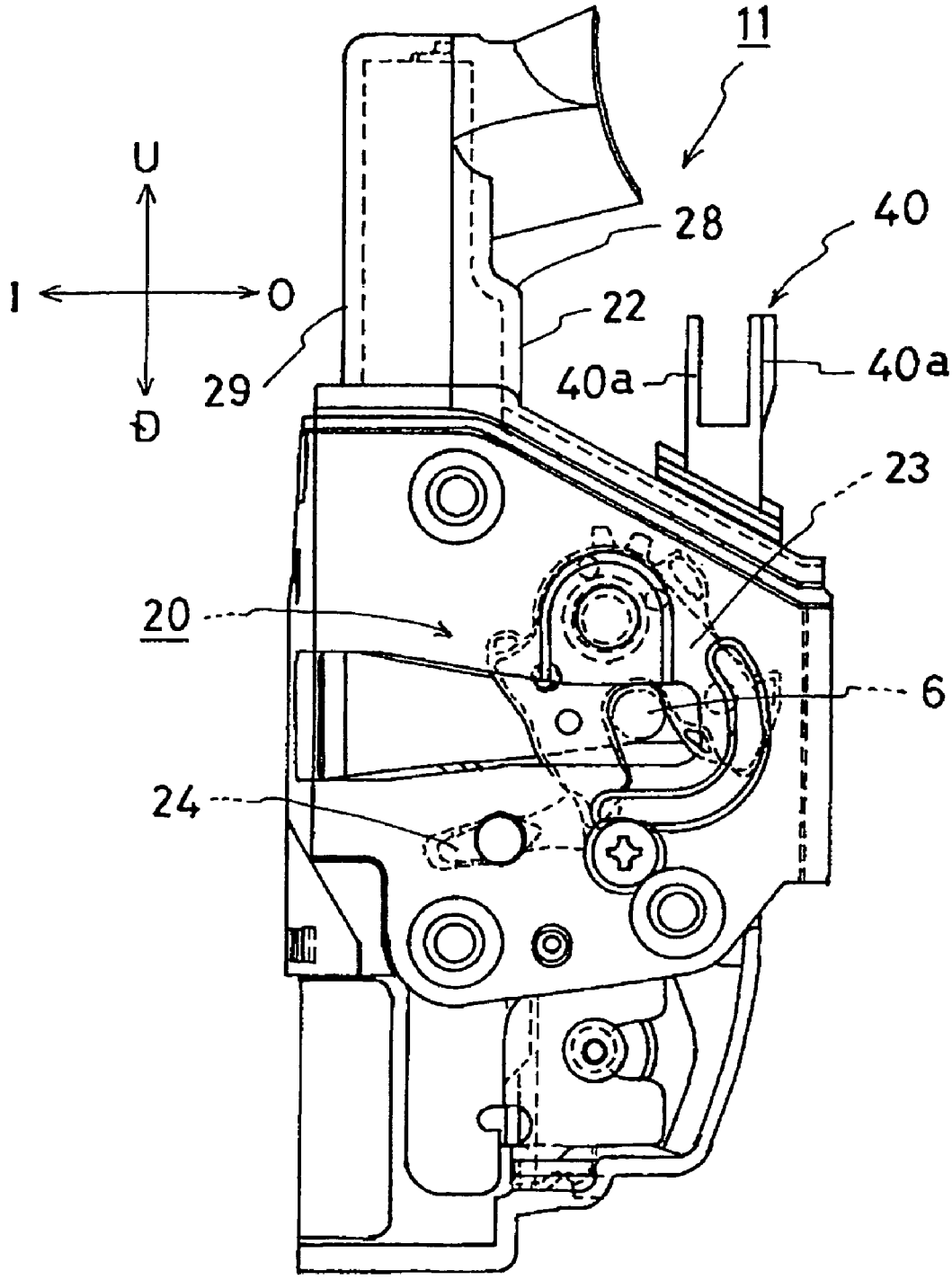
FIG. 3 is a back view schematically illustrating a door lock device according to the first embodiment of the present invention.
Figure 4:
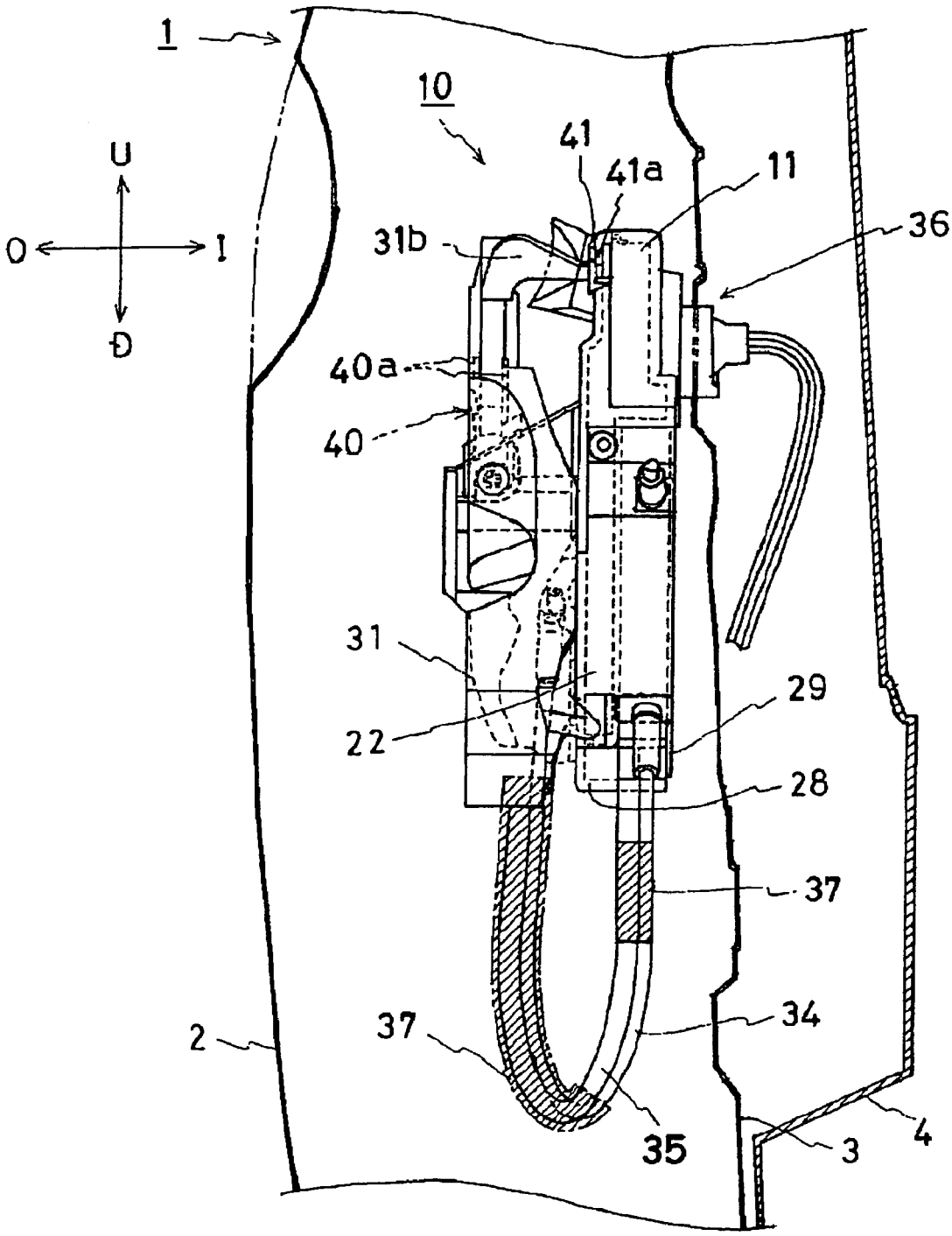
FIG. 4 is a front view schematically illustrating a door lock module in attaching process to a vehicle door according to the first embodiment of the present invention.
Figure 5:
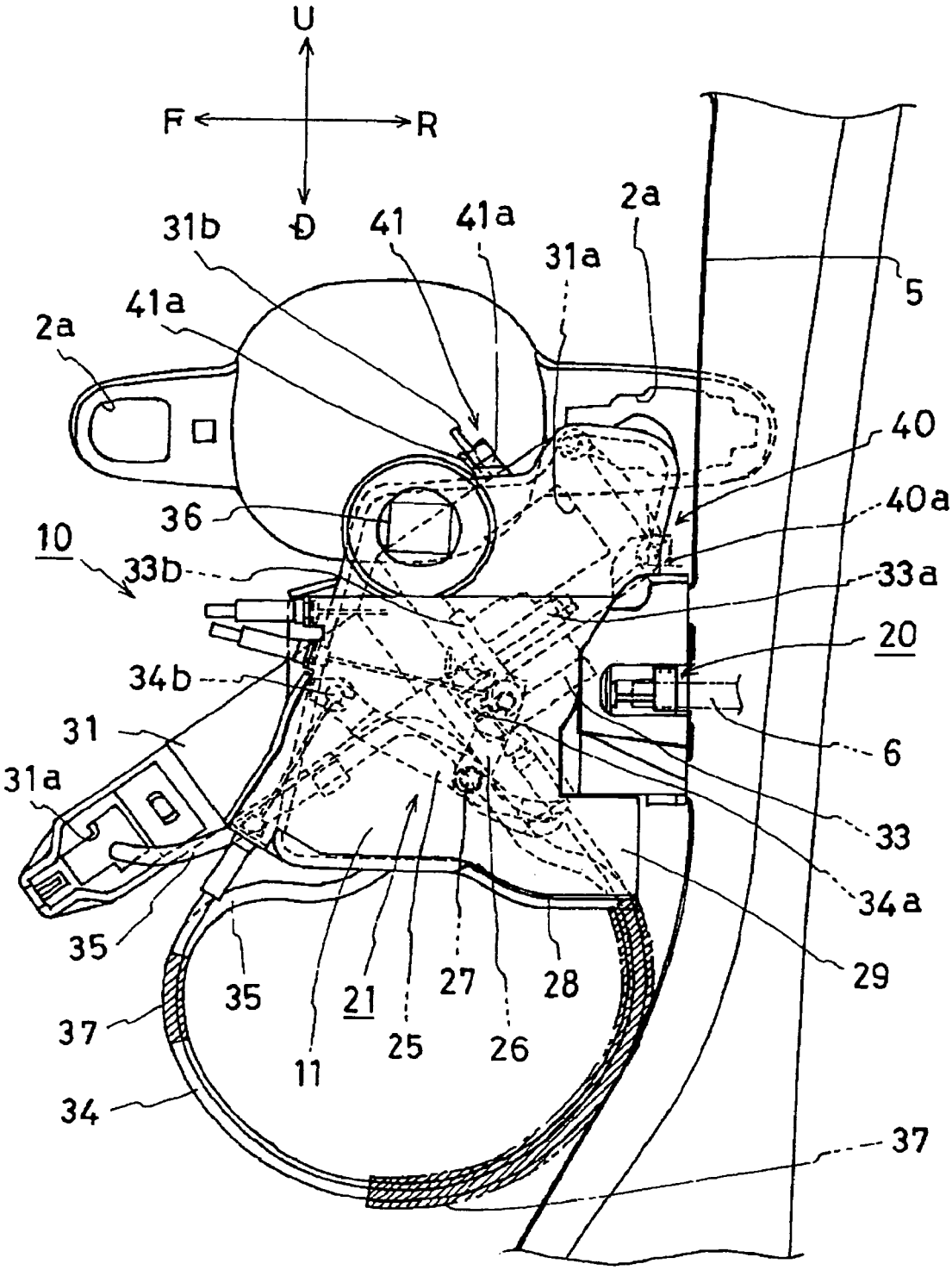
FIG. 5 is a side view schematically illustrating a door lock module in attaching process to a vehicle door according to the first embodiment of the present invention.
Figure 6:
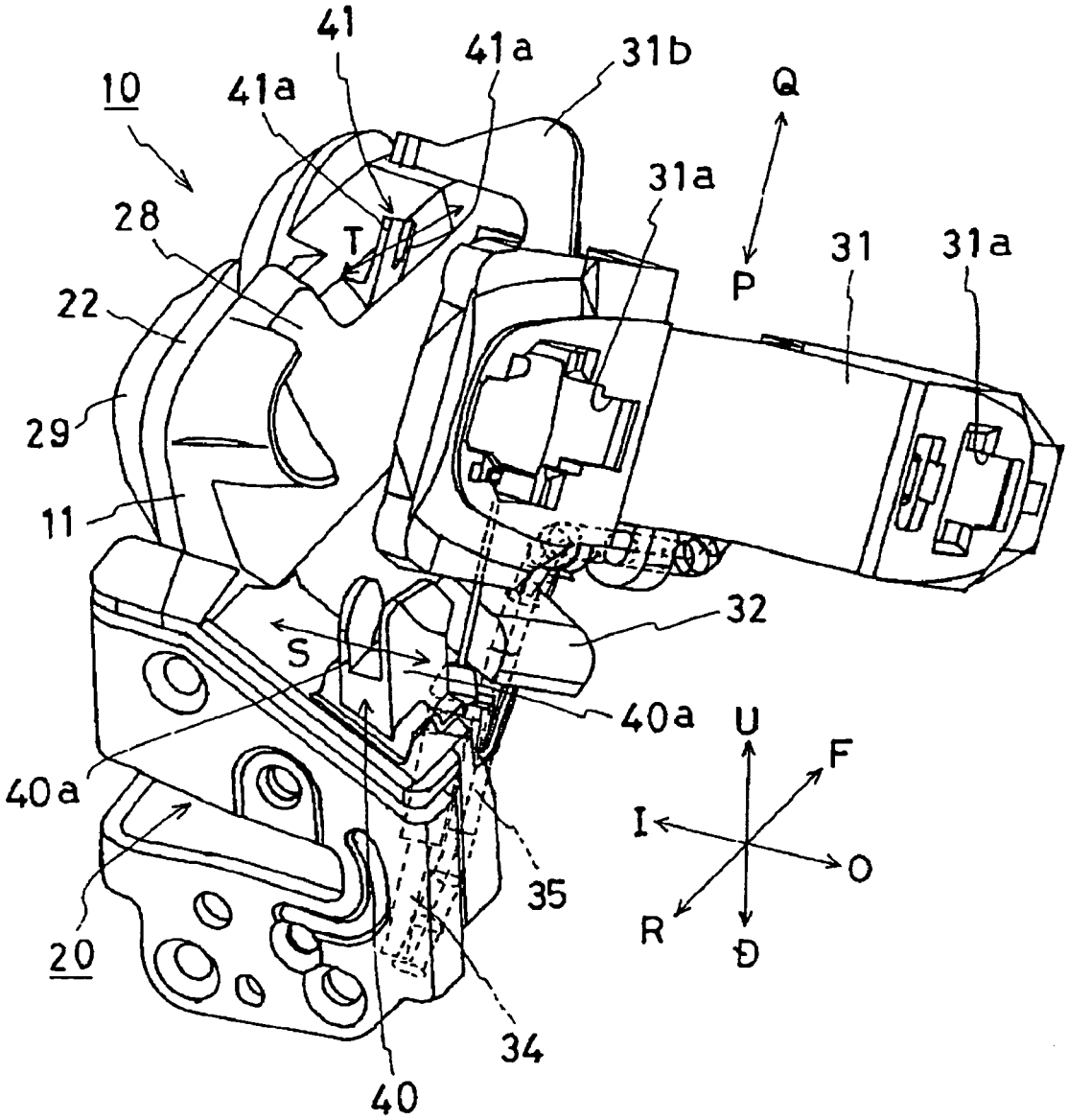
FIG. 6 is a perspective view schematically illustrating a door lock module according to the first embodiment of the present invention.

Hereinafter, a first embodiment according to the present invention will be explained using FIG. 1–FIG. 6. FIG. 1 and FIG. 2 shows a condition wherein a door lock module 10 is attached to a door 1. Although the door will be explained as a swing type door provided at the side of the vehicle in the first embodiment, provided position of the door is not limited to this configuration. For example, a door may be provided at rear side of a vehicle and may also be made as a slidable door. FIG. 1 is a schematic viewed from the front side of the vehicle (hereinafter referred to as the front side) to the rear side of the vehicle (hereinafter referred to as the rear side). FIG. 2 is a schematic viewed from the inside of the vehicle (hereinafter referred to as the inside) to the outside of the vehicle (hereinafter referred to as the outside). FIG. 2 shows a condition wherein an inner panel 3 (shown in FIG. 1) and an inner trim 4 (shown in FIG. 1) of the door 1 are removed. FIG. 3 is a rear view of a door lock device 11 composing the door lock module 10. FIG. 4 and FIG. 5 shows a condition wherein only the door lock device 11 of the door lock module 10 is rigidly attached to the door 1, and a handle frame 31 composing the door lock module 10 is not attached to the door 1. FIG. 4 and FIG. 5 are schematics viewed from the same direction as FIG. 1 and FIG. 2, respectively. FIG. 6 is a perspective view of the door lock module 10. In these schematics, correspondence of each symbols and direction is F as the front side, R as the rear side, U as the upper side of the vehicle (hereinafter referred to as the upper side), D as the down side of the vehicle (hereinafter referred to as the down side), I as the inside, and O as the outside.

As shown in FIG. 1 and FIG. 2, the door 1 is formed with bending of an outer panel 2 positioned at the outside, the inner trim 4 forming appearance of the inside, and the inner panel 3, and includes them and a end panel portion 5 covering the rear side of the door 1. Further, the door lock module 10 is provided between the outer panel 2 and the inner panel 3 of the door 1 (namely the inside of the door) as shown in FIG. 1 and FIG. 2.

As shown in FIGS. 1–6, the door lock module 10 includes the door lock device 11 and the handle frame 31.

The door lock device 11 includes a latch mechanism 20 (shown in FIG. 3) and a link mechanism 21 (shown in FIG. 2). The latch mechanism 20 and the link mechanism 21 are integrally accommodated in a housing 22 for preventing unwanted operation and penetration of water from the outside. The latch mechanism 20 has a known composition, and includes a striker 6 (shown in FIG. 2 and FIG. 3) rigidly attached to the vehicle body side, and a pole 24 for restricting movement of the latch 23. As shown in FIG. 3, the latch 23 is engaged with the striker 6, and the pole 24 contacts to the latch 23 with restricting movement of the latch 23. Thus, the latch mechanism 20 keeps the door 1 in closing condition by restricting movement of the latch 23. The link mechanism 21 is composed of various levers, links, motors, and so on. An outside open lever 25 and an inside open lever 26 composing the link mechanism 21 is shown in FIG. 2. When a handle grip 32 rigidly attached to the outer panel 2 is operated, the operation force is inputted to the outside open lever 25, and the outside open lever 25 rotates via a pivot 27. Also, when a inside handle (not shown) rigidly attached to the inner panel 3 or the inner trim 4 is operated, the operation force from the inside handle is inputted to the inside open lever 26, and the inside open lever 26 rotates via the pivot 27.

The link mechanism 21 is composed so as to release contacting condition of the pole 25 and the latch 23 according to operation of the outside open lever 25 and the inside open lever 26. In other wards, the link mechanism 21 releases engaging condition with the striker 6 by operating the latch mechanism 20 and makes the door 1 openable condition.

Further, the link mechanism 21 also has a mechanism for changing between unlocking condition wherein the latch mechanism 20 is movable and locking condition wherein the latch mechanism 20 is not movable by means of operation of the outside open lever 25 and the inside open lever 26 as described above (not shown in figures in detail).

The housing 22 is a combination of a case 28 covering outside of the door lock device 11 and a cover 29 covering inside as shown in FIG. 1.

As shown in FIG. 1 and FIG. 6, a first supporting portion 40 and a second supporting portion 41 are disposed at the case 28 of the housing 22 for detachably connecting with the handle frame 31. Although the first supporting portion 40 is attached to a portion of the case 28 which covers up side of the latch mechanism 20 of the door lock device 11, may be integrally formed with the housing 22. The first supporting portion 40 includes a pair of plates 40*a* which are placed beside each other with a predetermined distance in S direction (in FIG. 6) which is inside—outside direction of the vehicle and is defined as a first direction. On the other hand, the second supporting portion 41 is integrally formed with the upper portion of the case 28 of the housing 22. The second supporting portion 41 includes a pair of plates 41*a* which are placed beside each other with a predetermined distance in T direction (in FIG. 6) which is front—rear direction of the vehicle and is defined as a second direction.

Next, an outside handle unit 30 will be explained. The outside handle unit 30 is mainly composed of the handle frame 31, the handle grip 32, and a bell crank 33 as shown in FIG. 1 and FIG. 2. The handle frame 31 is made of resin and attachable in inside of the door 1 so as to place its longitudinal direction as front—rear direction as shown in FIG. 2. In other wards, the handle frame 31 is attachable to inside of the outer panel 2 using screws et al. A pair of opening portions 31*a* is provided at front and rear sides of the handle frame 31 to match with a pair of opening portions 2*a* formed at the outer panel 2 as shown in FIG. 2.

A connection arm 31*b* is formed at the handle frame 31 as shown in FIG. 1 and FIG. 6. The connection arm 31*b* is formed so as to elongate to the inside direction of the vehicle which is door lock device 11 side, and its end is bend to approximately right angle to direct toward the front side direction so as to shape a hook as shown in FIG. 6. The bending angle is not limited to accurate right angle. The handle grip 32 is formed by combining two members made of resin or metal so as to make hollow structure in it.

The handle grip 32 is attached from outside of the outer panel 2 (outside of the door 1) to place its longitudinal direction as front—rear direction. In other wards, an arm (not shown) formed at front and rear ends of the handle grip 32 is inserted to opening portions 2*a* and opening portions 31*a*, and the handle grip 32 is supported by the handle frame 31.

The bell crank 33 is pivotally supported via a pivot 33*a* (shown in FIG. 1) near the rear side end of the handle frame 31. Although it is not shown in figures, the arm formed at rear end of the handle grip 32 is engaged with an arm 33*b* of the bell crank 33. When the handle grip 32 is operated, the bell crank 33 pivots via the pivot 33*a*.

Further, as shown in FIG. 1, one end 34*a* of a cable 34 is engaged with the bell crank 33. The other end 34*b* of the cable 34 is engaged with the outside open lever 25 as shown in FIG. 2. In other wards, the cable 34 connects the outside open lever 25 and the bell crank 33. Then, when the bell crank 33 is pivoted via the pivot 33*a*, the cable 34 is pulled by the bell crank 33, and the outside open lever 25 is actuated. In this point, the cable 34 transmits an operation force from the outside handle unit 30 to the door lock device 11.

Electric parts (not shown) are provided in hollow portion of the handle grip 32. Although an antenna electrode transmitting signal to outside of the vehicle for detecting whether an user is exist or not near the vehicle, a sensor electrode for detecting that a user approaches to the handle grip 32 or contacts with the handle grip 32 may be used as examples of electric parts, it is not limited to these examples. For example, a switch for changing the door lock device 11 between unlocking condition and locking condition and a switch for electronically operating the latch mechanism 20.

A harness 35 is electrically connected to the electric parts. As shown in FIG. 1, the harness 35 is wired in the door 1 via the opening portion 2*a* and the opening portion 31*a*, and connected with a circuit board (not shown) provided in the door lock device 11. In other wards, the harness 35 electrically connects the outside handle unit 30 and the door lock device. On the other hand, the circuit board is connected to a ECU (Electronic Control Unit) placed outside of the door lock device 11 via a connector 36 provided at the housing 22 of the door lock device 11.

A protector 37 makes the harness 36 and the cable 34 unit body as shown in FIG. 1 and FIG. 2. Therefore, the harness 35 is stably supported in the door 1 by the cable 34.

Next, assembling method of the door lock module 10 to the door 1 will be explained. The door lock module 10 is made to modularized condition by attaching the door lock device 11 and the handle frame 31 prior to assembling to the door 1. First, this attaching method will be explained. When the handle frame 31 is moved from the condition shown in FIG. 6 to P direction, plates 40*a* of the first supporting portion 40 hold the handle frame 31 in S direction, and plates 41*a* of the second supporting portion 41 hold the connection arm 31*b* in T direction. Then, the first supporting portion 40 and plates 40*a* of the door lock device 11 are combined to the handle frame 31. In this condition, the first supporting portion 40 and the second supporting portion 41 hold the handle frame 31 in different directions (S and T directions) to prevent unwanted movement of the handle frame 31. Namely, the handle frame 31 is stably supported by the door lock device 11. The connection arm 31*b* with hook like shape is engaged to the second supporting portion 41. Especially, this engagement may prevent unwanted movement of the handle frame in S direction at the second supporting portion 41. Then, the handle frame 31 is stably supported by the door lock device 11.

As the door lock module 10 is modularized, the door lock module 10 is put in inside of the door 1 through an opening portion (not shown) formed at the inner panel 3 of the door 1. Next, a part of the door lock device 11 is fixed to the end panel portion 5 using screws et al. as shown in FIG. 4 and FIG. 5.

Since engagement between the door lock device 11 and the handle frame 31 is detachable, from the condition shown in FIG. 4 and FIG. 5, the handle frame 31 is detached from the door lock device 11 by moving the handle frame 31 into Q direction (shown in FIG. 6). The handle frame 31 is fixed to the outer panel 2 of the door 1 using screws et al. The door lock device 11 and the handle frame 31 of the door lock module 10 are assembled to the door 1 in this way.

According to the first embodiment of the present invention, the door lock device 11 and the handle frame 31 composing the outside handle unit 30 are modularized, and the door lock module 10 can be put in inside of the door 1 at a time. Thus, parts putting operation into the door 1 is needed fewer times than that the door lock device 11 and the outside handle unit 30 are individually put into the door 1. Consequently, assembling of the door lock device 11 and the outside handle unit 30 to the door 1 may be easily carried out.

According to the first embodiment of the present invention, the first supporting portion 40 and the second supporting portion 41 are provided at the housing 22 of the door lock device 11, and the handle frame 31 is attached to the housing composing exterior of the door lock device 11. Thus, engagement composition of the door lock device 11 and the handle frame 31 are simple, engagement and disengagement between the handle frame 31 and the door lock device 11 may be easily carried out. As shown in FIG. 4 and FIG. 5, the cable 34 is wired to connect the bell crank 33 and the outside open lever 25 in the door lock module 10 prior to put in the door 1. The harness 35 is wired to connect the handle frame 31 and the door lock device 11 electrically. Therefore, as shown in FIG. 1 and FIG. 2, the door lock device 11 including the cable 34 and the harness 35 and the outside handle unit 30 may be easily assembled to the door 1 without wiring the cable 34 and the harness 35 in the door 1 after the door lock device 10 and the handle frame 31 are fixed to the door.

Hereinafter operation of the door lock module 10 mentioned above will be briefly explained. When the link mechanism 21 of the door lock device 11 is in unlocking condition, the outside open lever 25 is actuated with operation of the handle grip 32 of the outside handle unit 30, and the latch mechanism 20 is actuated via several levers. Thus, condition of the door 1 is changed from closing condition to openable condition. On the other hand, when the link mechanism 21 of the door lock device 11 is in locking condition, although the outside open lever 25 is actuated with operation of the handle grip 32 of the outside handle unit 30, the latch mechanism 20 is not actuated. Namely, the door 1 may not be operated to open.

Although the grip operation type handle grip 32 is used as an example of the outside handle in the first embodiment, a pull up type outside handle may be used.

Although the handle frame 31 is used as an example of a door interior member in the first embodiment of the present invention, it is not limited to this configuration as long as the door interior member is attached to the door 1 in the door 1. For example, the handle frame 31 may be combined with the handle frame 31 as the door interior member. In addition, a key cylinder may be combined with the door interior member.

Although the cable 34 is used in the first embodiment of the present invention, the door lock device 11 side and the handle frame 31 side may be connected via a rod et al. as substitute for the cable 34.

Although the first supporting portion 40 and the second supporting portion 41 are attached to the housing 22 in the first embodiment of the present invention, they may be attached to the door lock device 11 via bracket et al.

SECOND EMBODIMENT

Figure 7:
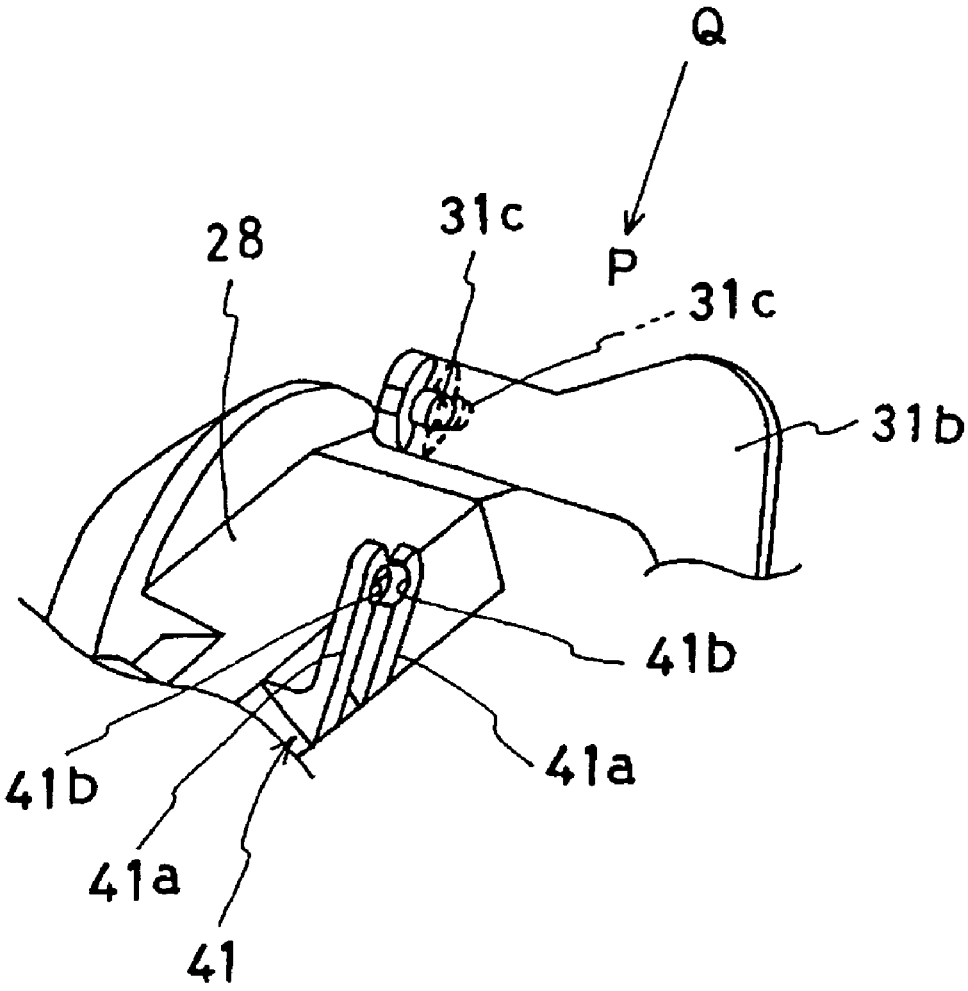
FIG. 7 is a perspective view schematically illustrating a part of connection arm and a second supporting portion of a door lock module according to the second embodiment of the present invention.

Next, a second embodiment of the present invention will be explained with reference to FIG. 7. The connection arm 31*b* and the second supporting portion 41 of the second embodiment are different from the first embodiment thereof Explanation of the other portions is abbreviated since they are same as the first embodiment thereof. FIG. 7 is a schematic viewed along the same direction with the FIG. 6 of the first embodiment, and only showing the connection arm 31 and the second supporting portion 41.

As shown in FIG. 7, the connection arm 31*b* is formed to have hook shape with bending to both front direction and rear direction at its end portion, and projection portions 31*c* are formed at both sides of the bending portion of the connection arm 31*b*. On the other hand, holding side of a pair of plates 41*a* of the second supporting portion 41 is formed to have a concave portion 41*b*.

From the condition shown in FIG. 7, when the connection arm 31*b* is moved to P direction to combine the handle frame to the door lock device 11, the concave portion 41*b* holds projection portions 31*c* with holding the connection arm 31*b* at the second supporting portion 41. Holding action between the concave portion 41*b* and projection portions 31*c* is snap-fit type. Consequently, dislocation of the connection arm 31*b* to Q direction may be prevented. Then, the handle frame 31 is stably supported by the door lock device 11.

THIRD EMBODIMENT

Figure 8:
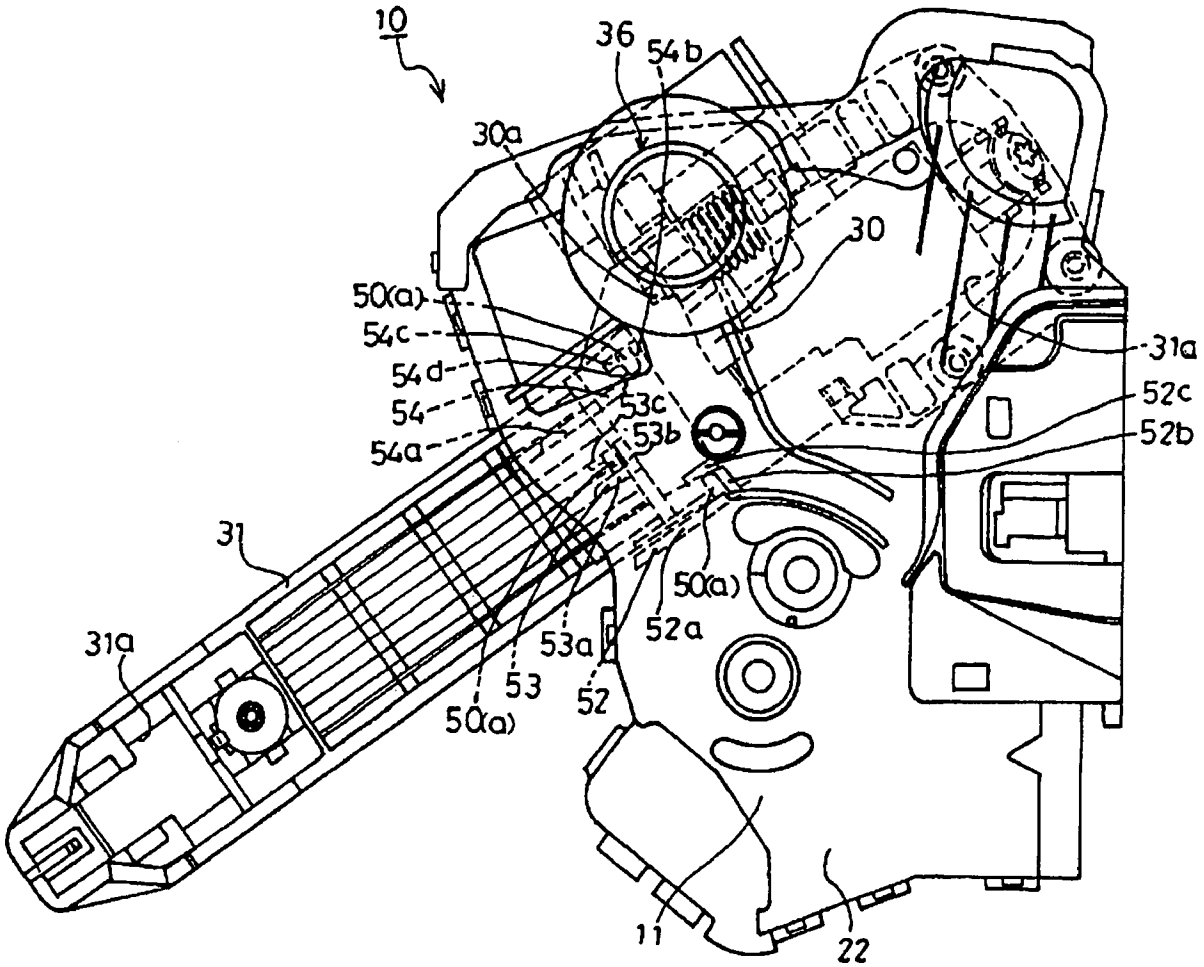
FIG. 8 is a side view schematically illustrating a door lock module according to the third embodiment of the present invention.
Figure 9:
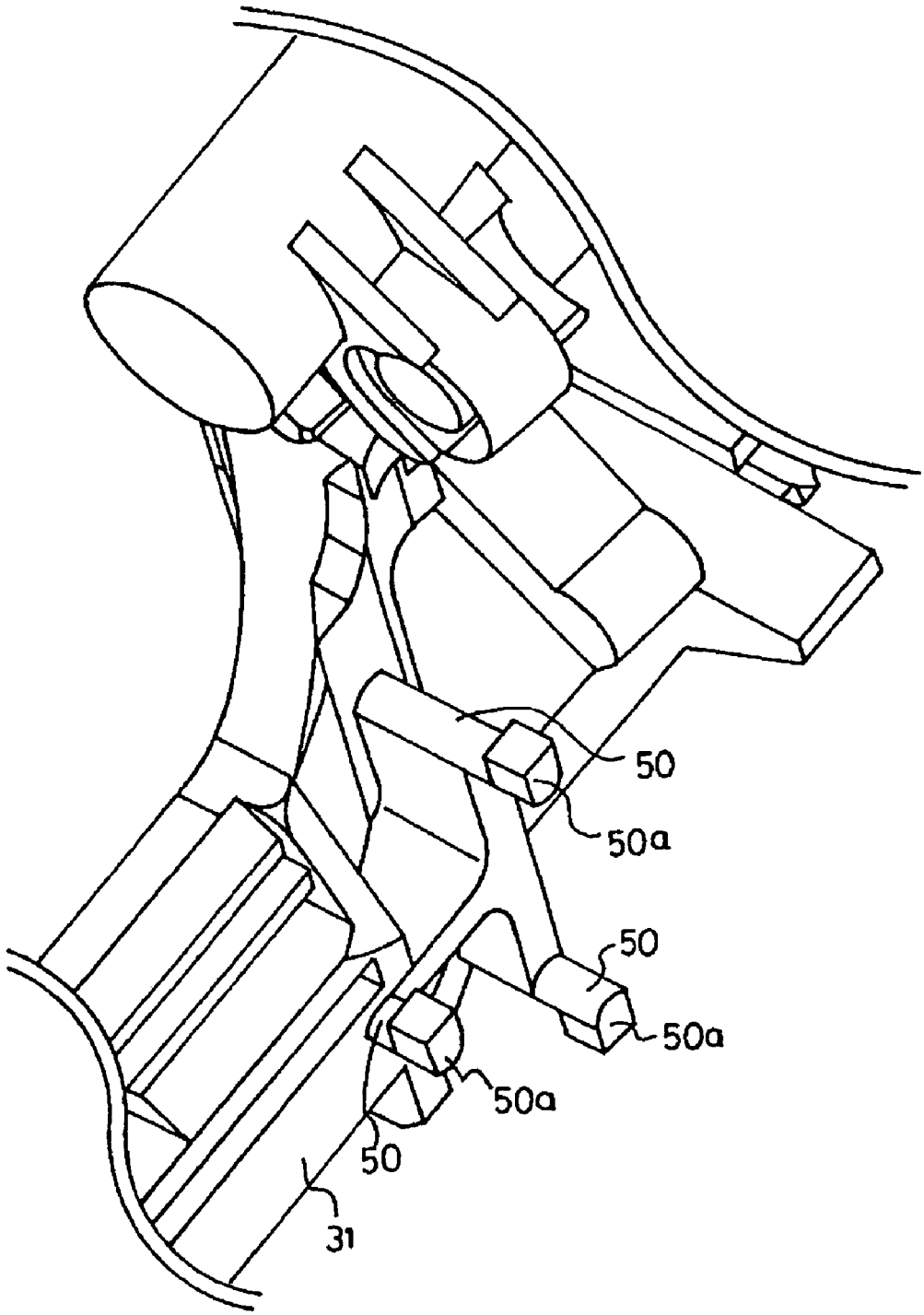
FIG. 9 is a perspective view schematically illustrating a part of a handle frame according to the third embodiment of the present invention.
Figure 10:
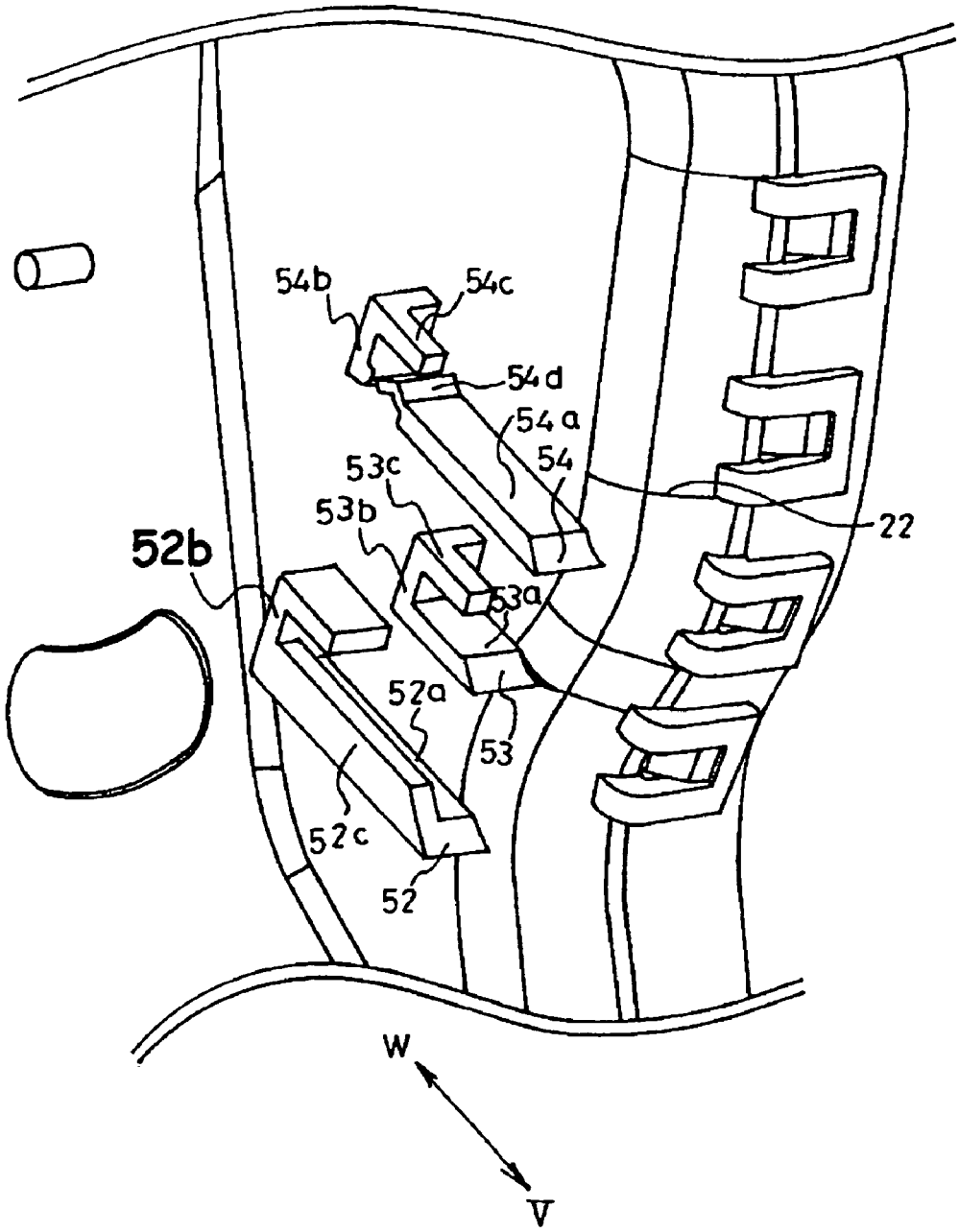
FIG. 10 is a perspective view schematically illustrating a part of a door lock device according to the third embodiment of the present invention.

Next, a third embodiment of the present invention will be explained with reference to FIG. 8–FIG. 10. In the third embodiment, attaching method of the handle frame 31 and the door lock device 11 is different from the first embodiment thereof. Also, shape of the housing 22 is different from the first embodiment of the present invention. Explanation of the other portions is abbreviated since they are same as the first embodiment thereof. FIG. 8 is a schematic showing the handle frame 31 and the door lock device 11 of the door lock module 10, and is viewed along the same direction with FIG. 5 of the first embodiment. FIG. 9 is a perspective view of the part of the handle frame 31. FIG. 10 is perspective view of a part of the door lock device 11.

As shown in FIG. 8 and FIG. 9, the handle frame 31 includes three snap portions 50 projecting to the door lock device 11 side. An end portion 50*a* of each snap portion 50 is projected to normal angle direction to the door lock device 11 direction.

On the other hand, the door lock device 11 includes three guide portions 52, 53, 54 as shown in FIG. 8 and FIG. 10. Guide portions 52, 53, 54 are integrally formed with the housing 22 of the door lock device 11. Three guide portions 52, 53, 54 have guide walls 52*a*, 53*a*, 54*a*, respectively. Guide walls 52*a*, 53*a*, 54*a* are formed along the housing 22 with elongating in VW direction (shown in FIG. 10) which is defined as a third direction. The guide portion 52 has a stop wall 52*b* formed at end portion of the guide wall 52*a* and a lock wall 52*c* elongating in the same direction with the guide wall 52*a* and forming a gap between it and the housing 22. The guide portion 53 has a stop wall 53*b* formed at end portion of the guide wall 53*a* and a lock portion 53*c* elongating in the same direction with the guide wall 53*a* and forming a gap between it and the housing 22. The guide portion 54 also has a stop wall 54*b* and a lock portion 54*c* as same as the guide portion 53. Further, the guide portion 54 has a bend portion 54*d* formed so as to bend the guide wall 54*a*.

Modularizing method of the door lock module 10 will be explained here. The door lock module 10 is made as combination of both the door lock device 11 and the handle frame 31. First, each end portion 50*a* of the snap portion 50 the handle frame 31 is engaged with each guide portions 52, 53, 54 of the door lock device 11 in W direction (shown in FIG. 10), and the handle frame 31 is moved along the each guide wall 52*a*, 53*a*, 54*a* to the W direction. Next, the handle frame 31 is slide until stopped wherein each end portion 50*a* contacts to each stop wall 52*b*, 53*b*, 54*b*. Consequently, the door lock device 11 and the handle frame 31 are combined, and the door lock module 10 is modularized (shown in FIG. 8). Namely, each end portion 50*a* is fitted between the housing 22 and the lock wall 52*c* or lock portions 53*c*, 54*c* in this condition. In other wards, each end portion 50*a* is engaged with the lock wall 52*c* and lock portions 53*c*, 54*c*, and unwanted movement of the handle frame 31 to the door lock device 11 may be prevented. In addition, movement of the snap portion 50 in VW direction is restricted since the bend portion 54*d* engages with the end portion of the snap portion 50 in this condition. Then, the handle frame 31 may not easily detached from the door lock device 11 by moving to V direction (shown in FIG. 10).

The combination between the door lock device 11 and the handle frame 31 is detachable. After the door lock module 10 is put in inside of the door 1, the handle frame 31 is detached from the door lock device 11 as described below. When the handle frame 31 is pushed to V direction with more than predetermined force, the end portion 50*a* passes the bend portion 54*d*. Then, guide walls 52*a*, 53*a*, 54*a* of the guide portions 52, 53, 54 guides each end portion 50*a* of the snap portion 50 to V direction. The snap portion 50 is detached from guides 52, 53, 54 by moving to V direction. Thus, the handle frame 31 is detached from the door lock device 11.

Form and number of the snap portion 50 and guides 52, 53, 54 are not limited to this embodiment.

FOURTH EMBODIMENT

Figure 11:
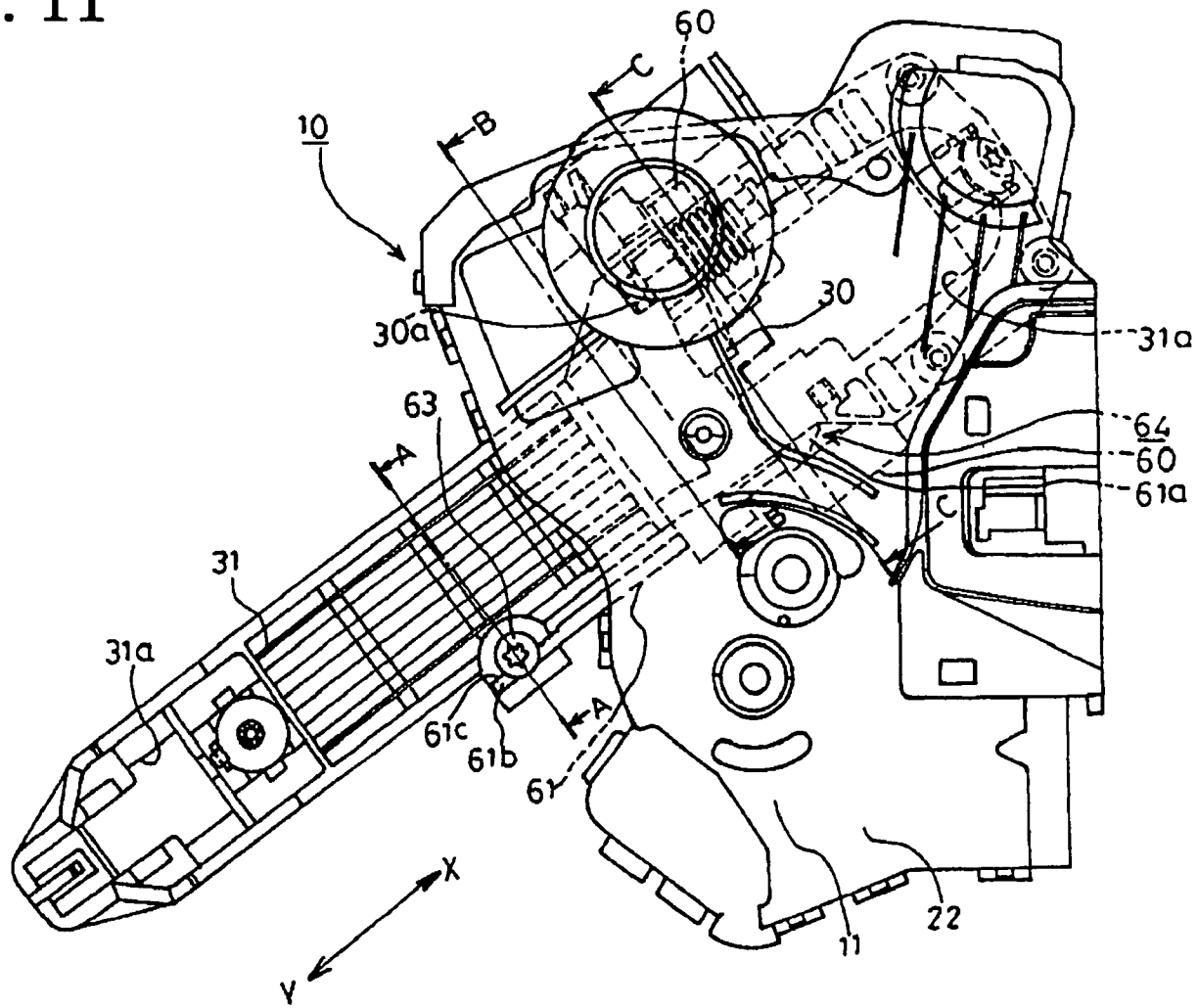
FIG. 11 is a side view schematically illustrating a door lock module according to the fourth embodiment of the present invention.
Figure 12:
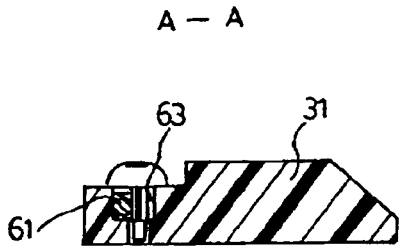
FIG. 12 is a cross sectional view taken along line A—A in FIG. 11.
Figure 13:
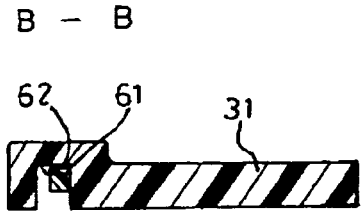
FIG. 13 is a cross sectional view taken along line B—B in FIG. 12.

Next, a fourth embodiment of the present invention will be explained with reference to FIG. 11–FIG. 14. In the fourth embodiment, attaching method of the handle frame 31 and the door lock device 11 is different from the first embodiment thereof. Also, shape of the housing 22 is different from the first embodiment there of. Explanation of the other parts is abbreviated since they are same as the first embodiment thereof FIG. 11 is a schematic showing the handle frame 31 and the door lock device 11 of the door lock module 10, and is viewed along the same direction with FIG. 5. FIG. 12 is a cross sectional view taken along line A—A in FIG. 11. FIG. 13 is a cross sectional view taken along line B—B in FIG. 11. FIG. 13 is a cross sectional view taken along line C—C in FIG. 11.

Figure 14:
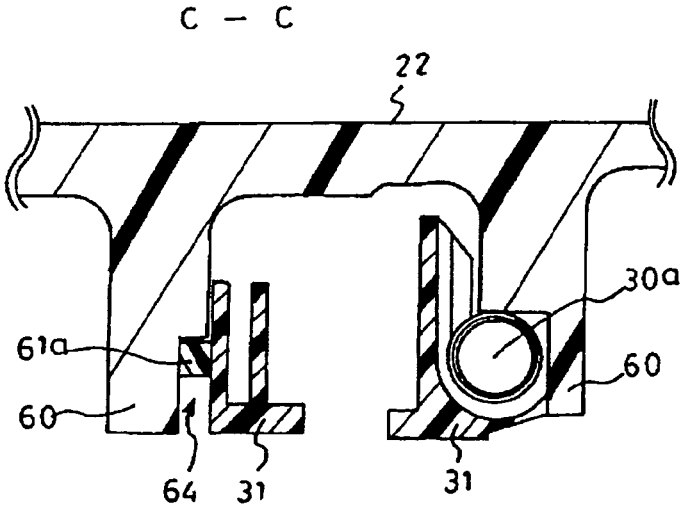
FIG. 14 is a cross sectional view taken along line C—C in FIG. 13.

As shown in FIG. 11 and FIG. 14, two ribs 60 projecting to the handle frame 31 side (upper direction in FIG. 14) at the housing 22. On the other hand, a locking member 61 is provided at the handle frame 31. As shown in FIG. 11 and FIG. 13, in the vicinity of the middle in longitudinal direction, the locking member 61 is held in a ditch 62 (shown in FIG. 13) which is formed on the handle frame 31. One end 61*a* of the locking member 61 is formed to have taper shape. The locking member 61 includes a driven gear 61*c* at the other end 61*b* thereof The driven gear 61*c* is engaged with a drive gear 63 (drive gear) attached to the handle frame 31. When the drive gear 63 is actuated (rotated), the locking member 61 moves in XY direction (push in—pull out direction) shown in FIG. 11.

Modularizing method of the door lock module 10 will be explained here. The door lock module 10 is made as combination of both the door lock device 11 and the handle frame 31. First, the handle frame 31 is placed between a pair of ribs 60. In this condition, the handle frame 31 is placed with forming a space 64 between the handle frame 31 and the rib 60 (shown in FIG. 11, FIG. 14). Next, the drive gear 63 is actuated (rotated) in one direction, and the locking member 61 is moved to X direction. In this condition, one end 61*a* of the locking member 61 is pushed into the space 64. The handle frame 31 is pressed to the locking member 61 and the rib 60. Consequently, the handle frame 31 is combined to the door lock device 11, and the door lock module 10 is modularized.

The combination between the door lock device 11 and the handle frame 31 is detachable. After the door lock module 10 is put in inside of the door 1, the handle frame 31 is disengaged from the door lock device 11 as described below. First, the drive gear 63 is actuated (rotated) in the other direction, and the locking member 61 is moved to Y direction. In this condition, one end 61*a* of the locking member 61 is pulled out from the space 64. The handle frame 31 is released from pressed condition to the locking member 61 and the rib 60. Consequently, the handle frame 31 is discharged from the door lock device 11.

The drive gear 63 can be rotated using a tool (screwdriver et al.) for attaching the door lock device 11 and the handle frame 31 to the door 1. Therefore, a few tools are used in assembling, and it makes assembling easy.

Form and number of ribs 60 are not limited to this embodiment.

FIFTH EMBODIMENT

Figure 15:
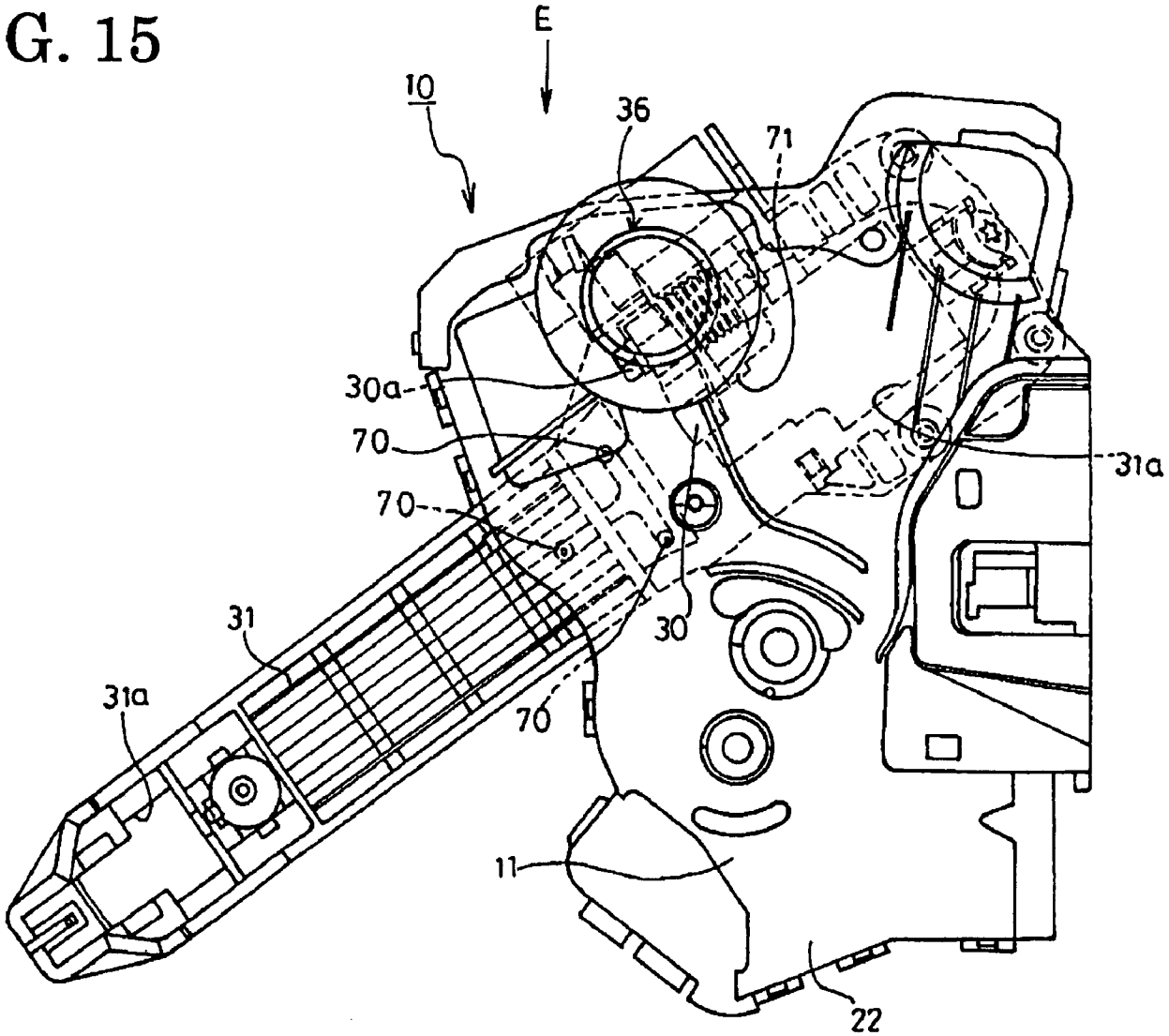
FIG. 15 is a side view schematically illustrating a door lock module according to the fifth embodiment of the present invention.
Figure 16:
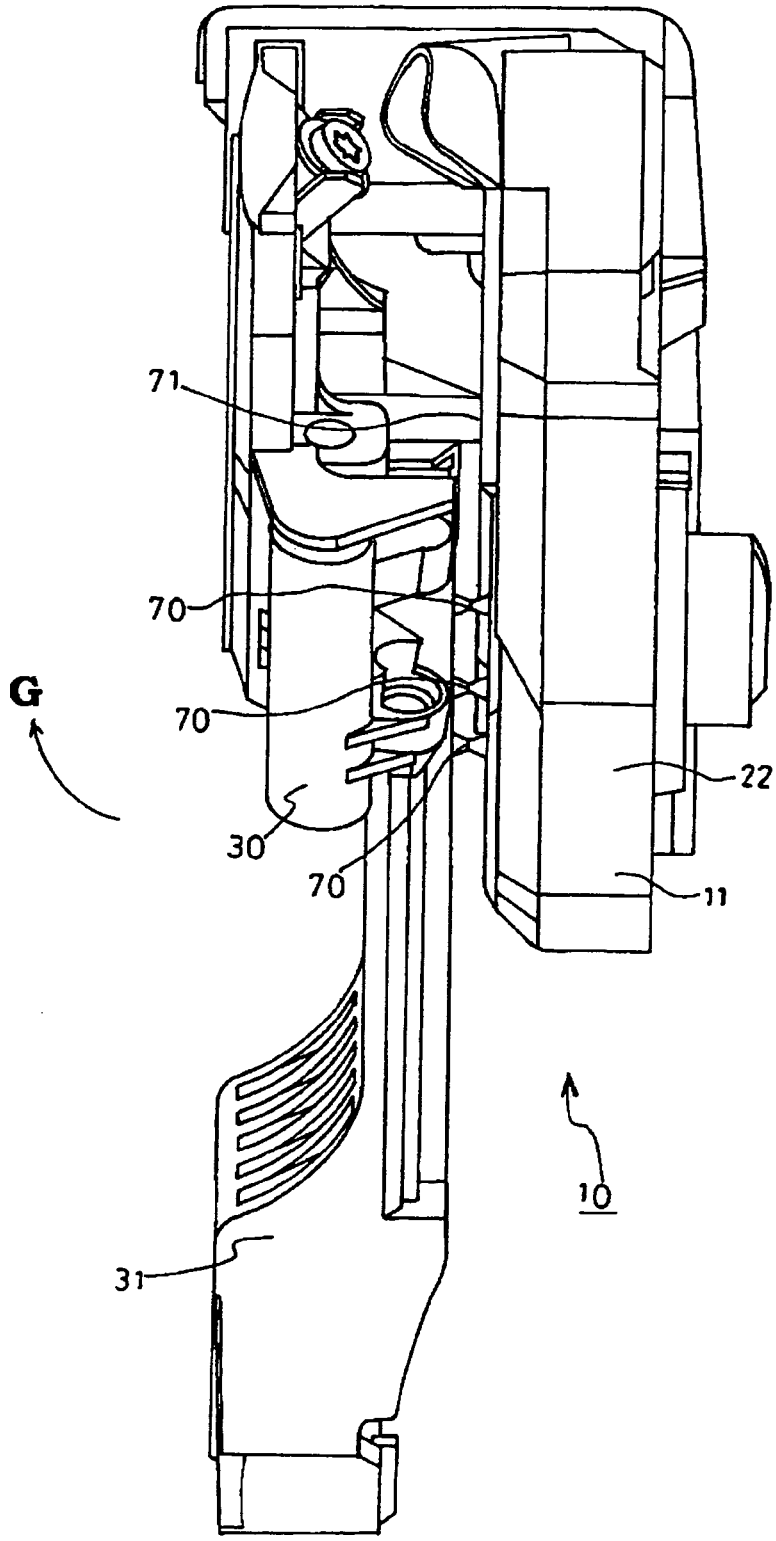
FIG. 16 is a side view viewed along the arrow E in FIG. 15.
Figure 17:
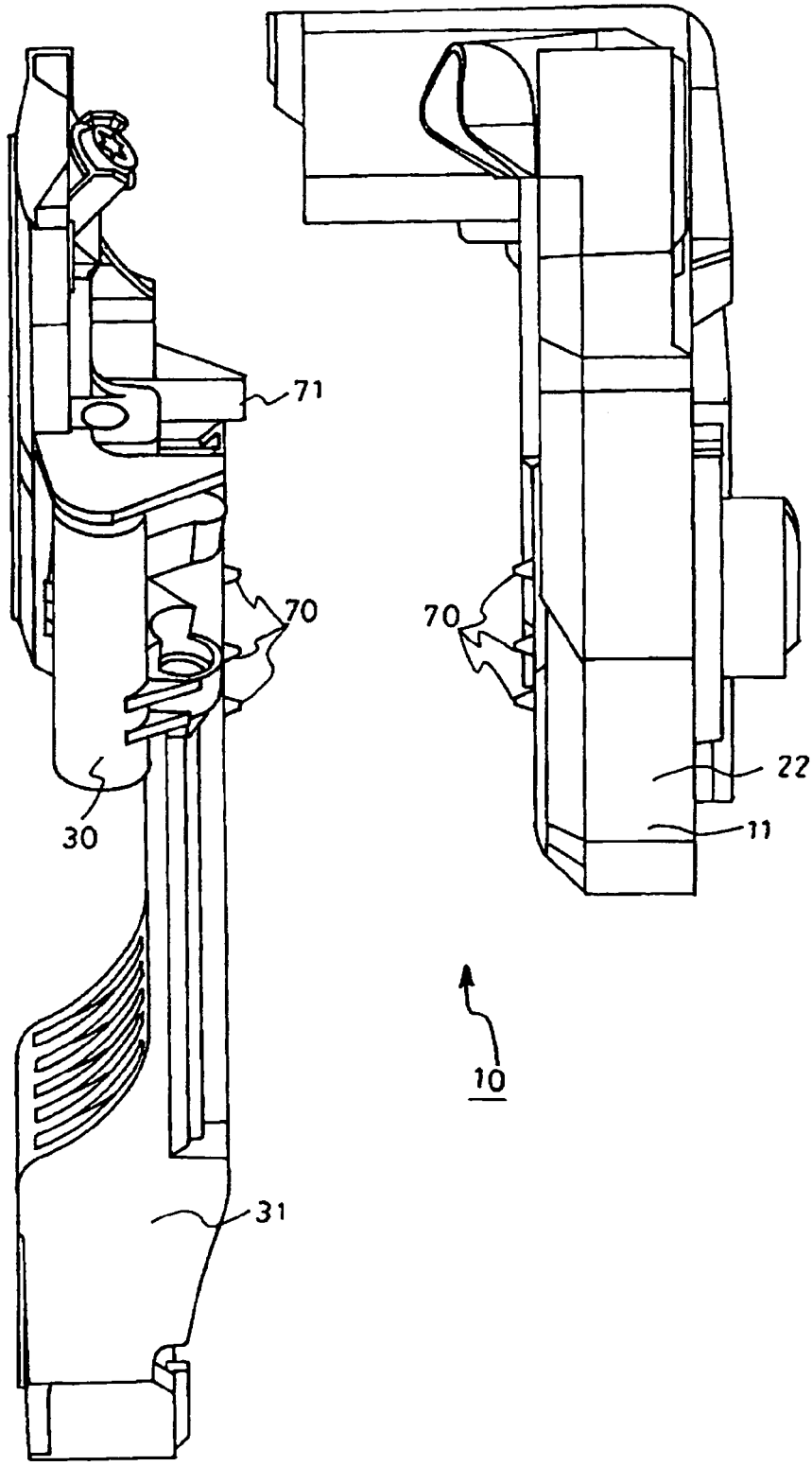
FIG. 17 is a side view schematically illustrating a handle frame and a door lock device in divided condition according to the fifth embodiment of the present invention.

Next, a fifth embodiment of the present invention will be explained with reference to FIG. 15–FIG. 17. In the fifth embodiment, attaching method of the handle frame 31 and the door lock device 11 is different from the first embodiment thereof. Also, shape of the housing 22 is different from the first embodiment there of. Explanation of the other parts is abbreviated since they are same as the first embodiment thereof. FIG. 15 is a schematic showing the handle frame 31 and the door lock device 11 of the door lock module 10, and is viewed along the same direction with FIG. 5 of the first embodiment. FIG. 16 is a schematic viewed along the arrow E in FIG. 15. FIG. 17 shows the handle frame 31 and the door lock device in divided condition viewed along the same direction as FIG. 16.

In the fifth embodiment, the door lock device 11 and the handle frame 31 are detachably combined by a welding as an adhesive material using heat, ultra sonic, et al. Namely, the door lock module 10 is formed by welding between the housing 22 of the door lock device 11 and the handle module 31 at three connection points 70 (shown in FIG. 15 and FIG. 16).

After the door lock module 10 is put in inside of the door 1, the handle frame 31 is detached from the door lock device 11 as described below. From a condition shown in FIG. 16, a force is applied to the handle frame 31 to G direction in FIG. 16. In this condition, the G direction tensile force is transmitted to connection points 70 via the handle frame 31 and to a contacting point 71 as a fulcrum, and connection points 70 are divided. Then, the handle frame 31 is detached from the door lock device 11 (shown in FIG. 17).

Form and number of connection points 70 are not limited to this embodiment. The door lock module 10 may be composed with detachably combining the door lock device 11 and the handle frame 31 at connection points 70 using a bonding as the adhesive material.

The principles, a preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door lock module comprising:

a door lock device including a latch mechanism arrangeable in a vehicle door for holding the vehicle door in a closing condition against a vehicle body by engaging with a vehicle body side, and a lock mechanism releasable from an engaging condition with the vehicle body side by operating the latch mechanism based on operation of an opening operation member;

a door interior member forming the opening operation member, the door interior member being arrangeable in the vehicle door and detachably connected with the door lock device;

wherein the door lock device includes a first supporting portion supporting the door interior member in a first direction and a second supporting portion supporting a connection arm formed at the door interior member in a second direction which is different from the first direction; and an input member composing the lock mechanism and an output lever composing the door interior member are connected via a cable which transmits an operation force from the opening operation member to the door lock device.

2. A door lock module according to claim 1, wherein the door lock device includes a housing accommodating the latch mechanism and the lock mechanism, and the door interior member is combined with the housing.

3. A door lock module according to claim 1, wherein the connection arm has a hook shape for engaging with the second supporting portion.

4. A door lock module according to claim 1, wherein the connection arm includes a projecting portion, and the second supporting portion includes a concave portion, and the second supporting portion supports the connection arm when the concave portion receives the projecting portion.

5. A door lock module according to claim 1, wherein the door interior member includes a snap portion, and the door lock device engages with the snap portion and includes a guide portion guiding the snap portion in a third direction, the snap portion engages with or disengages from the guide portion when moved in the third direction.

6. A door lock module according to claim 5, wherein a restriction means is formed at the guide portion for restricting movement of the snap portion in the third direction.

7. A door lock module according to claim 1, wherein the door lock device includes at least one rib, and a space which is positioned between plural ribs and formed between the door interior member and the rib, and the door interior member includes a locking member for pushing into the space and for pulling out from the space.

8. A door lock module according to claim 7, wherein the locking member is provided at the door interior member and includes a driven gear which is engaged with a drive gear provided at the door interior member and is moved so as to be pushed into the space and to be pulled from the space according to actuation of the drive gear.

9. A door lock module according to claim 1, wherein the door lock device and the door interior member are detachably combined by fusion.

10. A door lock module according to claim 1, wherein the door lock device and the door interior member are detachably combined using adhesive material.

11. A door lock module according to claim 1, wherein the door interior member is attached to an inner side of a panel of the vehicle door and serves as a frame for supporting a door handle composing the opening operation member.

* * * * *